US012398481B1

(12) United States Patent
Dervishi-Whetham et al.

(10) Patent No.: US 12,398,481 B1
(45) Date of Patent: Aug. 26, 2025

(54) HIGH-QUALITY RHENIUM AND RHENIUM ALLOY COATINGS THROUGH ELECTRODEPOSITION

(71) Applicant: Triad National Security, LLC, Los Alamos, NM (US)

(72) Inventors: Enkeleda Dervishi-Whetham, Los Alamos, NM (US); Michael Anthony McBride, Los Alamos, NM (US); Daniel Edwin Hooks, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 0 days.

(21) Appl. No.: 18/470,693

(22) Filed: Sep. 20, 2023

Related U.S. Application Data

(60) Provisional application No. 63/376,479, filed on Sep. 21, 2022.

(51) Int. Cl.
*C25D 3/54* (2006.01)
*C25D 5/18* (2006.01)
*C25D 5/56* (2006.01)

(52) U.S. Cl.
CPC ..... *C25D 3/54* (2013.01); *C25D 5/18* (2013.01); *C25D 5/56* (2013.01)

(58) Field of Classification Search
None
See application file for complete search history.

(56) References Cited

U.S. PATENT DOCUMENTS

| | | | | |
|---|---|---|---|---|
| 2,616,840 | A | 11/1952 | Levi | |
| 3,285,839 | A * | 11/1966 | Camp | C25D 3/54 205/262 |
| 3,688,083 | A | 8/1972 | Rice et al. | |
| 3,890,210 | A | 6/1975 | Stevens et al. | |
| 7,955,488 | B2 | 6/2011 | Tsai et al. | |
| 10,094,033 | B2 | 10/2018 | Chen et al. | |
| 2012/0122657 | A1 | 5/2012 | Eliaz et al. | |

FOREIGN PATENT DOCUMENTS

| | | | | |
|---|---|---|---|---|
| RU | 2749778 C1 * | 6/2021 | ..... | C25D 3/54 |

OTHER PUBLICATIONS

Bautista-Ruiz et al., Rasāyan J. Chem., vol. 14, No. 2, 2021 (Year: 2021).*
Chernyshev et al. RU 2749778 C1, machine translation (Year: 2021).*
Rosen et al. Journal of Electroanalytical Chemistry 731 '2014' 93-99 (Year: 2014).*
M.S. Chandrasekar et al., "Pulse and pulse reverse plating—Conceptual, advantages and applications," Electrochimica Acta, 53:3313-3322, (2008).

* cited by examiner

*Primary Examiner* — Wojciech Haske
(74) *Attorney, Agent, or Firm* — Alston & Bird LLP

(57) ABSTRACT

Provided are methods of preparing electroplated articles having rhenium or rhenium alloy layers deposited thereon. The methods utilize pulse reverse waveforms to avoid hydrogen and rhenium oxide evolution. Articles prepared using the methods, and electrolyte solutions used in the methods, are also provided.

15 Claims, 3 Drawing Sheets

HIGH-QUALITY RHENIUM AND RHENIUM ALLOY COATINGS THROUGH ELECTRODEPOSITION

CROSS-REFERENCE TO RELATED APPLICATION(S)

This application claims priority to, and the benefit of, U.S. Provisional Application Ser. No. 63/376,479, filed Sep. 21, 2022, which is hereby incorporated herein by reference in its entirety for all purposes.

FIELD

The present invention relates generally to methods of electrodepositing rhenium and rhenium alloys, and products with an electrodeposited rhenium or rhenium alloy coating prepared using said methods.

BACKGROUND

Rhenium (Re) has unique and superior properties when compared with other refractory metals, making it attractive as an engineering material. It has a very high modulus of elasticity and superior tensile strength and creep-rupture strength over a wide temperature range. Re is very resistant to highly corrosive environments, possesses a very high melting point, and has enhanced wear resistance properties. Rhenium is used as a critical component in electronic applications as the pure metal and its oxides exhibit similar electrical properties. Rhenium is also critical in aerospace applications as it is highly resistant to harsh environments including high friction at high temperatures. Coatings of rhenium would allow the engineering use of all of these properties without necessarily requiring bulk rhenium for entire parts, presenting a great economic advantage, given that rhenium is both relatively expensive and difficult to process.

There have been very few demonstrations of electrodepositing rhenium in the literature, or, in fact, any viable methods for commercial production of rhenium films.

Accordingly, there still exists a need for viable methods of producing high quality rhenium films and products coated with rhenium films.

SUMMARY

An embodiment of the invention is a method of electrodepositing a rhenium layer on a substrate, the method comprising:

i) providing an electrodeposition system, wherein the electrodeposition system comprises an anode, a cathode, an electrolyte solution, and a power supply; wherein the cathode comprises the substrate to be coated; wherein the power supply is connected to the anode and the cathode; wherein the anode and the cathode are in the electrolyte solution; and wherein the electrolyte solution comprises a rhenium compound, a first salt, and an acid;

ii) using the power supply to provide electrical power in a waveform to the cathode and the anode; wherein the waveform is a pulse waveform or a pulse reverse waveform; the pulse waveform comprising a cathodic pulse and a period without current; the pulse reverse waveform comprising a cathodic pulse and an anodic pulse, thereby electrodepositing a rhenium layer on the substrate.

Another embodiment is a rhenium- or rhenium alloy-coated article prepared by such a method.

Another embodiment is an aqueous electrolyte solution, comprising:

i) a rhenium compound;
ii) sulfuric acid;
iii) lithium chloride; and
iv) citric acid.

BRIEF DESCRIPTION OF THE SEVERAL VIEWS OF THE DRAWINGS

Figure 1A:
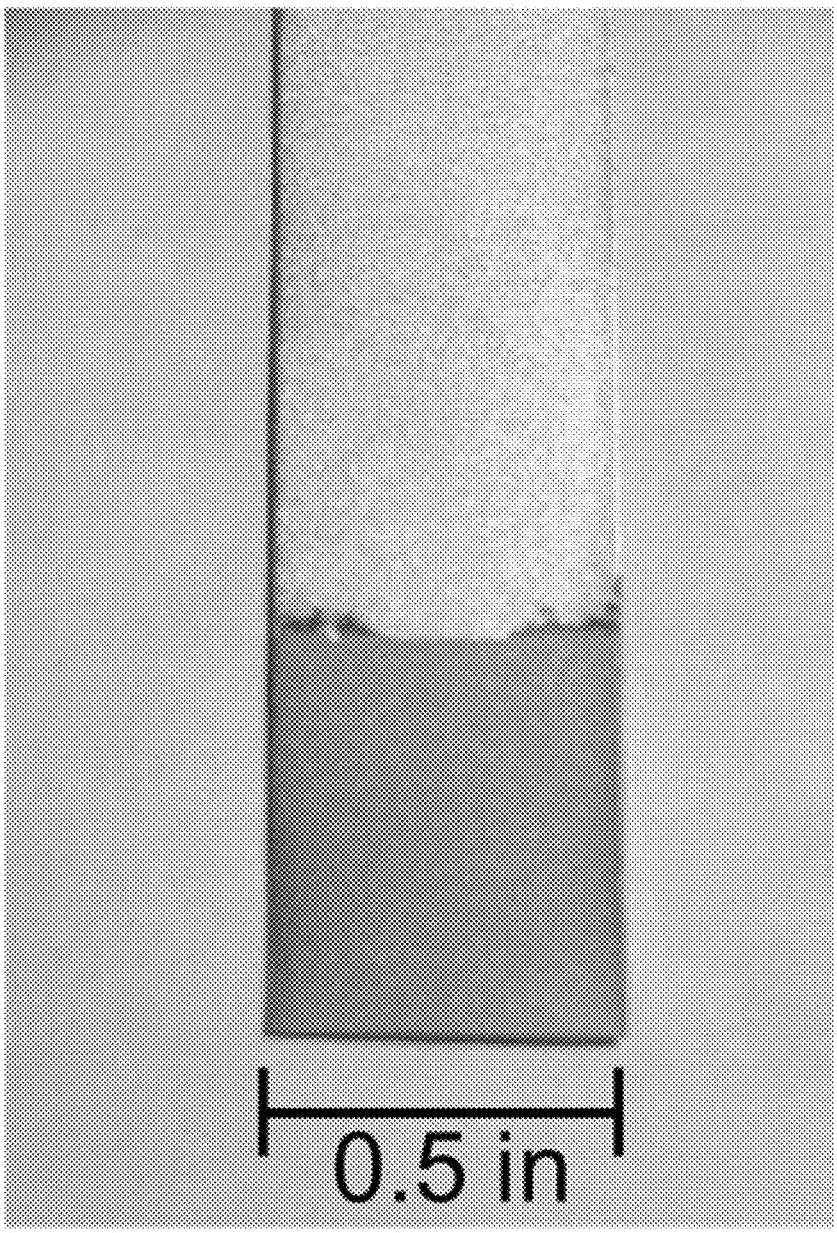

Having thus described the invention in general terms, reference will now be made to the accompanying drawings, which are not necessarily drawn to scale, and wherein:

FIG. 1A shows a gold-coated stainless steel substrate with an electrodeposited rhenium coating at micron thickness.

Figure 1B:
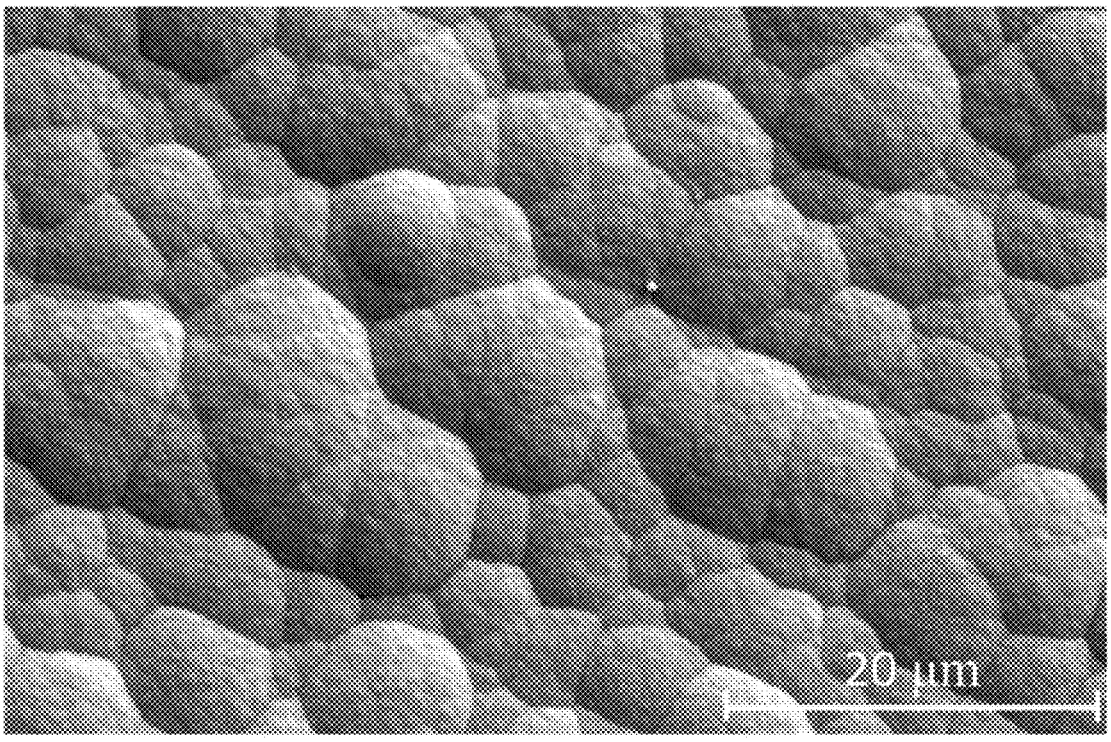

FIG. 1B shows a SEM image of the electrodeposited rhenium.

Figure 2:
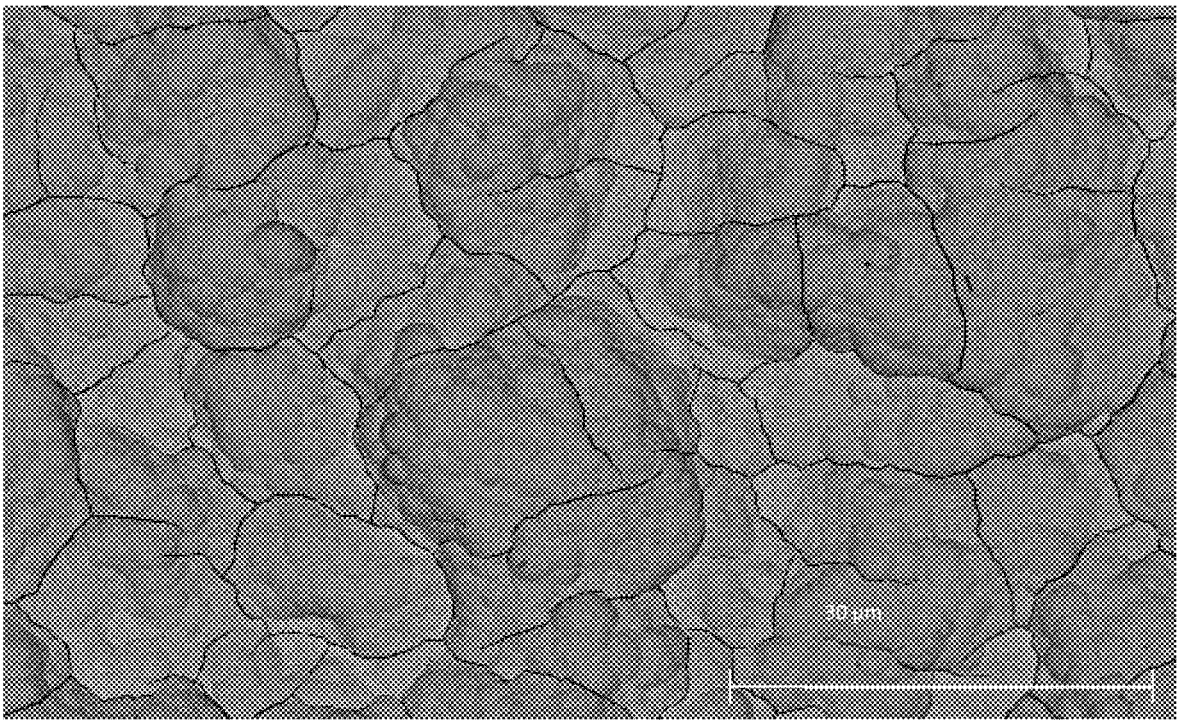

FIG. 2 shows an SEM image of a copper substrate with an electrodeposited rhenium coating.

DETAILED DESCRIPTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. As used in the specification, and in the appended claims, the singular forms "a", "an", "the", include plural referents unless the context clearly dictates otherwise.

Definitions

For the purposes of the present application, the following terms shall have the following meanings:

The terms "about" and "substantially" as used herein means a deviation (plus/minus) of less than 10%, and in particular, less than 5%, less than 4%, less than 3%, or less than 2% of the recited value.

The term "metal salt" refers to a compound comprising a metal cation and an anion. Non-limiting examples include metal sulfates, metal chlorides, metal sulfamates, and metal fluoroborates.

"Iron salt" refers to any salt comprising iron. Non-limiting examples include ferrous sulfate, ferrous chloride, ferrous sulfamate, and ferrous tetrafluoroborate.

"Nickel salt" refers to any salt comprising nickel. Non-limiting examples include nickel sulfamate, nickel sulfate, and nickel chloride.

"Cobalt salt" refers to any salt comprising cobalt. Non-limiting examples include cobalt chloride and cobalt sulfate.

"Lithium salt" refers to any salt comprising lithium. Non-limiting examples include lithium carbonate, lithium acetate, lithium sulfate, lithium citrate, and lithium chloride.

"Chloride salt" refers to any salt comprising chlorine. Non-limiting examples include lithium chloride, potassium chloride, calcium chloride, and ammonium chloride.

"Rhenium salt" refers to any salt comprising rhenium. Non-limiting examples include ammonium perrhenate, potassium perrhenate, and sodium perrhenate.

"Rhenium acid" refers to any acid comprising rhenium. A non-limiting example is perrhenic acid.

"Alkaline earth metal" refers to any metal in Group 2 (IIa) of the periodic table. Examples include calcium, strontium, beryllium, barium, magnesium, and radium.

"Transition metals other than rhenium" refers to any metal in Groups 3-12 of the periodic table other than rhenium. Non-limiting examples include copper, iron, vanadium, manganese, titanium, cobalt, molybdenum, zinc, zirconium, tungsten, tantalum, nickel, silver, ruthenium, platinum, gold, and cadmium.

It is understood that where a parameter range is provided, all integers and ranges within that range, and tenths and hundredths thereof, are also provided by the embodiments. For example, "5-10%" includes 5%, 6%, 7%, 8%, 9%, and 10%; 5.0%, 5.1%, 5.2% . . . 9.8%, 9.9%, and 10.0%; and 5.00%, 5.01%, 5.02% . . . 9.98%, 9.99%, and 10.00%, as well as, for example, 6-9%, 5.1%-9.9%, and 5.01%-9.99%. Similarly, where a list is presented, unless stated otherwise, it is to be understood that each individual element of that list, and every combination of components of that list, is a separate embodiment. For example, "1, 2, 3, 4, and 5" encompasses, among numerous embodiments, 1; 2; 3; 1 and 2; 3 and 5; 1, 3, and 5; and 1, 2, 4, and 5.

An embodiment of the invention is a method of electrodepositing a rhenium layer on a substrate, the method comprising:

i) providing an electrodeposition system, wherein the electrodeposition system comprises an anode, a cathode, an electrolyte solution, and a power supply; wherein the cathode comprises the substrate to be coated; wherein the power supply is connected to the anode and the cathode; wherein the anode and the cathode are in the electrolyte solution; and wherein the electrolyte solution comprises a rhenium compound, a first salt, and an acid;

ii) using the power supply to provide electrical power in a waveform to the cathode and the anode; wherein the waveform is a pulse waveform or a pulse reverse waveform; the pulse waveform comprising a cathodic pulse and a period without current; the pulse reverse waveform comprising a cathodic pulse and an anodic pulse, thereby electrodepositing a rhenium layer on the substrate.

In a further embodiment, the electrolyte solution further comprises a base. In an embodiment, the base is ammonium hydroxide. In an embodiment, the base is present in an amount sufficient to change the pH of the electrolyte solution to a value from 0.7-2.0.

In an embodiment, the electrolyte solution further comprises a second salt, the second salt comprising a metal; and wherein the metal is electrodeposited with the rhenium, thereby forming a rhenium-metal alloy layer on the substrate. In a further embodiment, the second salt comprises a metal selected from the group consisting of iron, nickel, and cobalt.

In an embodiment, any of the rhenium compound, first salt, second salt, and acid are present in the electrolyte solution in a concentration from about 0.01 M to 8 M. In an embodiment, the concentration is about 0.01, 0.05, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, or 8.0 M. In an embodiment, the concentration is less than about 0.05, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, or 8.0 M. In an embodiment, the concentration is greater than about 0.01, 0.05, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, or 7.9 M.

In an embodiment, the rhenium compound is selected from the group consisting of a rhenium salt and a rhenium acid. In a further embodiment, the rhenium salt is selected from the group consisting of ammonium perrhenate, potassium perrhenate, and sodium perrhenate. In an embodiment, the rhenium salt is ammonium perrhenate. In an embodiment, the rhenium salt is potassium perrhenate. In an embodiment, the rhenium salt is sodium perrhenate.

In an embodiment, the first salt is a lithium salt. In an embodiment, the lithium salt is selected from the group consisting of lithium carbonate, lithium acetate, lithium sulfate, lithium citrate, and lithium chloride. In an embodiment, the lithium salt is lithium carbonate. In an embodiment, the lithium salt is lithium acetate. In an embodiment, the lithium salt is lithium sulfate. In an embodiment, the lithium salt is lithium citrate. In an embodiment, the lithium salt is lithium chloride.

In an embodiment, the first salt is a chloride salt. In an embodiment, the chloride salt is selected from the group consisting of lithium chloride, potassium chloride, calcium chloride, and ammonium chloride. In an embodiment, the chloride salt is lithium chloride. In an embodiment, the chloride salt is potassium chloride. In an embodiment, the chloride salt is calcium chloride. In an embodiment, the chloride salt is ammonium chloride.

In an embodiment, the rhenium layer consists of rhenium. In an embodiment, the rhenium layer comprises a rhenium alloy. In an embodiment, the rhenium alloy comprises rhenium in an amount of about 1% to about 99.999% by weight rhenium. In an embodiment, the rhenium alloy comprises at least, at most, or about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 99.9, 99.99, or 99.999% by weight rhenium.

In an embodiment, the rhenium alloy comprises iron, nickel, and/or cobalt in an amount of about 0.001 to 50% by weight. In an embodiment, the rhenium alloy comprises iron, nickel, and/or cobalt in an amount of at least, at most, or about 0.001, 0.01, 0.1, 0.2, 0.3, 0.4, 0.5, 0.6, 0.7, 0.8, 0.9, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50% by weight. In an embodiment, the rhenium alloy comprises iron in an amount of at least, at most, or about 0.001, 0.01, 0.1, 0.2, 0.3, 0.4, 0.5, 0.6, 0.7, 0.8, 0.9, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50% by weight. In an embodiment, the rhenium alloy comprises nickel in an amount of at least, at most, or about 0.001, 0.01, 0.1, 0.2, 0.3, 0.4, 0.5, 0.6, 0.7, 0.8, 0.9, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50% by weight. In an embodiment, the rhenium alloy comprises cobalt in an amount of at least, at most, or about 0.001, 0.01, 0.1, 0.2, 0.3, 0.4, 0.5, 0.6, 0.7, 0.8, 0.9, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50% by weight.

In an embodiment, the electrolyte solution comprises at least one of sulfuric acid and citric acid. In a further embodiment the electrolyte solution comprises sulfuric acid and citric acid.

In an embodiment, the electrolyte solution has a pH from about 0.7-2.0. In a further embodiment, the electrolyte solution has a pH from about 0.9-1.1. In an embodiment, the electrolyte solution has a pH of about 0.7, about 0.8, about 0.9, about 1.0, about 1.1, about 1.2, about 1.3, about 1.4, about 1.5, about 1.6, about 1.7, about 1.8, about 1.9, or about 2.0. In an embodiment, the electrolyte solution has a pH of less than about 0.8, about 0.9, about 1.0, about 1.1, about 1.2, about 1.3, about 1.4, about 1.5, about 1.6, about 1.7, about 1.8, about 1.9, or about 2.0. In an embodiment, the electrolyte solution has a pH of greater than about 0.7, about 0.8, about 0.9, about 1.0, about 1.1, about 1.2, about 1.3, about 1.4, about 1.5, about 1.6, about 1.7, about 1.8, or about 1.9.

In an embodiment, the cathodic pulse has a duration from 1-500 ms. In an embodiment, the cathodic pulse has a duration of about 5, 10, 15, 20, 25, 30, 35, 40, 45, 50, 55, 60, 65, 70, 75, 80, 85, 90, 95, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, or 500 ms. In an embodiment, the cathodic pulse has a duration of less than about 10, 15, 20, 25, 30, 35, 40, 45, 50, 55, 60, 65, 70, 75, 80, 85, 90, 95, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, or 500 ms. In an embodiment, the cathodic pulse has a duration of greater than about 5, 10, 15, 20, 25, 30, 35, 40, 45, 50, 55, 60, 65, 70, 75, 80, 85, 90, 95, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, or 490 ms.

In an embodiment, the anodic pulse or the period without a current has a duration from 2-1000 seconds. In an embodiment, the duration is about 2, 5, 10, 15, 20, 25, 30, 35, 40, 45, 50, 5, 60, 65, 70, 75, 80, 85, 90, 95, 100, 120, 140, 160, 180, 200, 220, 240, 260, 280, 300, 320, 340, 360, 380, 400, 420, 440, 460, 480, 500, 520, 540, 560, 580, 600, 620, 640, 660, 680, 700, 720, 740, 760, 780, 800, 820, 840, 860, 880, 900, 920, 940, 960, 980, or 1000 seconds. In an embodiment, the duration is less than about 5, 10, 15, 20, 25, 30, 35, 40, 45, 50, 5, 60, 65, 70, 75, 80, 85, 90, 95, 100, 120, 140, 160, 180, 200, 220, 240, 260, 280, 300, 320, 340, 360, 380, 400, 420, 440, 460, 480, 500, 520, 540, 560, 580, 600, 620, 640, 660, 680, 700, 720, 740, 760, 780, 800, 820, 840, 860, 880, 900, 920, 940, 960, 980, or 1000 seconds. In an embodiment, the duration is greater than about 2, 5, 10, 15, 20, 25, 30, 35, 40, 45, 50, 5, 60, 65, 70, 75, 80, 85, 90, 95, 100, 120, 140, 160, 180, 200, 220, 240, 260, 280, 300, 320, 340, 360, 380, 400, 420, 440, 460, 480, 500, 520, 540, 560, 580, 600, 620, 640, 660, 680, 700, 720, 740, 760, 780, 800, 820, 840, 860, 880, 900, 920, 940, 960, or 980 seconds.

In an embodiment, the ratio of the duration of the cathodic pulse to the duration of the anodic pulse or the period without a current is from about 1:100 to 1:200,000. In an embodiment, the ratio is about 1:100, 1:500, 1:1000, 1:1500, 1:2000, 1:2500, 1:3000, 1:3500, 1:4000, 1:4500, 1:5000, 1:6000, 1:7000, 1:8000, 1:9000, 1:10,000, 1:20,000, 1:30,000, 1:40,000, 1:50,000, 1:60,000, 1:70,000, 1:80,000, 1:90,000, 1:100,000, 1:120,000, 1:140,000, 1:160,000, 1:180,000, or 1:200,000. In an embodiment, the ratio is less than about 1:500, 1:1000, 1:1500, 1:2000, 1:2500, 1:3000, 1:3500, 1:4000, 1:4500, 1:5000, 1:6000, 1:7000, 1:8000, 1:9000, 1:10,000, 1:20,000, 1:30,000, 1:40,000, 1:50,000, 1:60,000, 1:70,000, 1:80,000, 1:90,000, 1:100,000, 1:120,000, 1:140,000, 1:160,000, 1:180,000, or 1:200,000. In an embodiment, the ratio is greater than about 1:100, 1:500, 1:1000, 1:1500, 1:2000, 1:2500, 1:3000, 1:3500, 1:4000, 1:4500, 1:5000, 1:6000, 1:7000, 1:8000, 1:9000, 1:10,000, 1:20,000, 1:30,000, 1:40,000, 1:50,000, 1:60,000, 1:70,000, 1:80,000, 1:90,000, 1:100,000, 1:120,000, 1:140,000, 1:160,000, or 1:180,000.

In an embodiment, the cathodic pulse has a current density of from about 10-2,000 mA/in$^2$. In an embodiment, the cathodic pulse has a current density of about 10, 20, 30, 40, 50, 60, 70, 80, 90, 100, 120, 140, 160, 180, 200, 220, 240, 260, 280, 300, 320, 340, 360, 380, 400, 420, 440, 460, 480, 500, 520, 540, 560, 580, 600, 620, 640, 660, 680, 700, 720, 740, 760, 780, 800, 820, 840, 860, 880, 900, 920, 940, 960, 980, 1000, 1050, 1100, 1150, 1200, 1250, 1300, 1350, 1400, 1450, 1500, 1550, 1600, 1650, 1700, 1750, 1800, 1850, 1900, 1950, or 2000 mA/in$^2$. In an embodiment, the cathodic pulse has a current density of less than about 20, 30, 40, 50, 60, 70, 80, 90, 100, 120, 140, 160, 180, 200, 220, 240, 260, 280, 300, 320, 340, 360, 380, 400, 420, 440, 460, 480, 500, 520, 540, 560, 580, 600, 620, 640, 660, 680, 700, 720, 740, 760, 780, 800, 820, 840, 860, 880, 900, 920, 940, 960, 980, 1000, 1050, 1100, 1150, 1200, 1250, 1300, 1350, 1400, 1450, 1500, 1550, 1600, 1650, 1700, 1750, 1800, 1850, 1900, 1950, or 2000 mA/in$^2$. the cathodic pulse has a current density of greater than about 10, 20, 30, 40, 50, 60, 70, 80, 90, 100, 120, 140, 160, 180, 200, 220, 240, 260, 280, 300, 320, 340, 360, 380, 400, 420, 440, 460, 480, 500, 520, 540, 560, 580, 600, 620, 640, 660, 680, 700, 720, 740, 760, 780, 800, 820, 840, 860, 880, 900, 920, 940, 960, 980, 1000, 1050, 1100, 1150, 1200, 1250, 1300, 1350, 1400, 1450, 1500, 1550, 1600, 1650, 1700, 1750, 1800, 1850, 1900, 1950, or 2000 mA/in$^2$.

In an embodiment, the anodic pulse has a current density of from about 1-200 mA/in$^2$. In an embodiment, the anodic pulse has a current density of about 1, 2, 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, or 200 mA/in$^2$. In an embodiment, the anodic pulse has a current density of less than about 2, 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, or 200 mA/in$^2$. In an embodiment, the anodic pulse has a current density of greater than about 1, 2, 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, or 195 mA/in$^2$.

In an embodiment, the ratio of the current density of the cathodic pulse to the current density of the anodic pulse is from about 2:1 to about 50:1. In an embodiment, the ratio is about 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 22:1, 24:1, 26:1, 28; 1, 30:1, 32:1, 34:1, 36:1, 38; 1, 40:1, 42:1, 44:1, 46:1, 48; 1, or 50:1. In an embodiment, the ratio is less than about 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 22:1, 24:1, 26:1, 28; 1, 30:1, 32:1, 34:1, 36:1, 38; 1, 40:1, 42:1, 44:1, 46:1, 48; 1, or 50:1. In an embodiment, the ratio is greater than about 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 22:1, 24:1, 26:1, 28; 1, 30:1, 32:1, 34:1, 36:1, 38; 1, 40:1, 42:1, 44:1, 46:1, or 48:1.

In an embodiment, the process occurs at a temperature from about 20 to about 80° C. In an embodiment, the process occurs at a temperature of about 20, 25, 30, 35, 40, 45, 50, 55, 60, 65, 70, 75, or 80° C. In an embodiment, the process occurs at a temperature of less than about 25, 30, 35, 40, 45, 50, 55, 60, 65, 70, 75, or 80° C. In an embodiment, the process occurs at a temperature of greater than about 20, 25, 30, 35, 40, 45, 50, 55, 60, 65, 70, or 75° C.

In an embodiment, the substrate is a metal. In an embodiment, the substrate is selected from the group consisting of alkaline earth metals and transition metals other than rhenium. In an embodiment, the substrate is an alkaline earth metal. In an embodiment, the substrate is a transition metal other than rhenium. In an embodiment, the metal is an alloy. In an embodiment, the alloy is stainless steel.

In an embodiment, the substrate is a carbon-based material. In an embodiment, the carbon-based material is selected from the group consisting of graphene, graphite, graphene oxide, and carbon nanotubes. In an embodiment, the substrate is a plastic.

In an embodiment, the electrodeposition system is a barrel plating system. In an alternative embodiment, the electrodeposition system is a rack plating system. In an embodiment, the electrodeposition system is a vibratory plating system.

In an embodiment, the method produces a rhenium or rhenium alloy coating at a rate of about 0.01-5.0 microns per hour. In an embodiment, the method produces a coating at a rate of about 0.01, 0.05, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, or 5.0 microns per hour. In an embodiment, the method produces a coating at a rate of less than about 0.05, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, or 5.0 microns per hour. In an embodiment, the method produces a coating at a rate of greater than about 0.01, 0.05, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, or 4.9 microns per hour.

In an embodiment, prior to step i), the electrolyte solution is prepared by combining the rhenium compound, first salt, acid, and optional second salt, and, subsequently, adding the base to raise the pH to a target value.

Another embodiment is a rhenium- or rhenium alloy-coated article prepared by any method described herein.

In an embodiment, the rhenium or rhenium alloy coating has a thickness of about 0.5 to 50 microns. In an embodiment, the coating has a thickness of about 0.5, 0.6, 0.7, 0.8, 0.9, 1.0, 1.1, 1.2, 1.3, 1.4, 1.5, 1.6, 1.7, 1.8, 1.9, 2.0, 2.2, 2.4, 2.6, 2.8, 3.0, 3.2, 3.4, 3.6, 3.8, 4.0, 4.2, 4.4, 4.6, 4.8, 5.0, 5.2, 5.4, 5.6, 5.8, 6.0, 6.2, 6.4, 6.6, 6.8, 7.0, 7.2, 7.4, 7.6, 7.8, 8.0, 8.2, 8.4, 8.6, 8.8, 9.0, 9.2, 9.4, 9.6, 9.8, 10.0, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 microns. In an embodiment, the coating has a thickness of less than about 0.6, 0.7, 0.8, 0.9, 1.0, 1.1, 1.2, 1.3, 1.4, 1.5, 1.6, 1.7, 1.8, 1.9, 2.0, 2.2, 2.4, 2.6, 2.8, 3.0, 3.2, 3.4, 3.6, 3.8, 4.0, 4.2, 4.4, 4.6, 4.8, 5.0, 5.2, 5.4, 5.6, 5.8, 6.0, 6.2, 6.4, 6.6, 6.8, 7.0, 7.2, 7.4, 7.6, 7.8, 8.0, 8.2, 8.4, 8.6, 8.8, 9.0, 9.2, 9.4, 9.6, 9.8, 10.0, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 microns. In an embodiment, the coating has a thickness of greater than about 0.5, 0.6, 0.7, 0.8, 0.9, 1.0, 1.1, 1.2, 1.3, 1.4, 1.5, 1.6, 1.7, 1.8, 1.9, 2.0, 2.2, 2.4, 2.6, 2.8, 3.0, 3.2, 3.4, 3.6, 3.8, 4.0, 4.2, 4.4, 4.6, 4.8, 5.0, 5.2, 5.4, 5.6, 5.8, 6.0, 6.2, 6.4, 6.6, 6.8, 7.0, 7.2, 7.4, 7.6, 7.8, 8.0, 8.2, 8.4, 8.6, 8.8, 9.0, 9.2, 9.4, 9.6, 9.8, 10.0, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, or 49 microns.

In an embodiment, the article comprises a rhenium or rhenium alloy coating which is substantially uniform.

Another embodiment is an aqueous electrolyte solution, comprising:

i) a rhenium compound;
ii) sulfuric acid;
iii) lithium chloride; and
iv) citric acid.

In an embodiment, the electrolyte solution further comprises a metal salt selected from the group consisting of iron salts, nickel salts, and cobalt salts. In an embodiment, any or all of these components are present at a concentration as disclosed hereinabove, or in relative concentrations appropriate for preparing rhenium alloy coatings with weight percents as disclosed hereinabove.

DISCUSSION

Fabrication of Re-based films/coating via chemical vapor deposition (CVD) has been previously reported. However, adhesion is poor, and film delamination is common. CVD is also a vacuum process, which is both expensive and limits the sample size and geometry of the part, making this technique less desirable for large-scale applications. Electroplating at near-room temperature presents an alternative deposition technique for uniform Re coatings on large and complex shapes. However, Re is difficult to deposit by electrodeposition from water due to its very low overpotential for hydrogen evolution. There have been very few demonstrations of electrodepositing Re in the literature (including in U.S. Pat. Nos. 2,616,840; 3,285,839; 3,668,083; and 3,890,210, and U.S. Patent Pub. No. 2012/0122657, each of which are hereby incorporated by reference in their entireties), none of which have been successfully commercialized. Issues with these methods include: 1) pervasive cracks in the films from concurrent hydrogen evolution, 2) co-deposition of large amounts of Re oxide, which causes poor adhesion, and dark, powdery films and 3) limits to the deposit thickness, below typical engineering requirements.

Annealing has been presented as a post-electroplating process to enhance the properties, but adds additional cost and process complexity, and in any case has not had enough success to warrant commercialization. Rhenium alloys can help aid in decreasing the crack formation while acting as catalysts during the deposition process. Some literature has proposed electrodeposition using water-in-salt electrolytes for Re and Re-alloy deposition. Nonetheless, demonstrations including either alloying or novel electrolytes have not overcome problems of cracks within the films. As such, for some applications, components are machined at great expense from solid Re metal. There remains a strong commercial need for an economical, viable method to produce high quality Re films.

The methods and compositions described herein present improved electrolyte development as well as selection of optimal pulse and pulse-reverse waveforms for uniform deposition of metallic Re and its alloys. In particular, the use of a relatively short cathodic pulse, and a long reverse pulse (or period of zero current) allows for rhenium metal (or a rhenium alloy) to be put down on a substrate before any hydrogen evolves. If any hydrogen is evolved, it is captured by the water and salt in the aqueous electrolyte solution. The preferred substrate is an inert metal that is stable under acidic conditions.

Further, an additional advantage is provided by the method of preparation of the electrolyte solution. Specifically, the combination of rhenium compound, salt(s), and acid, and then adding a base after the other components have all been combined, helps keep the electrolyte solution stable for an extended period of time.

EXAMPLES

Electroplating Substrates

Example 1-Electroplating Gold-Coated Stainless Steel

The substrate material, gold-coated stainless steel, prepared via electrodeposition of gold on stainless steel from a potassium gold cyanide salt (Technic, Inc., Cranston, RI) was first cleaned and prepared for electroplating.

An aqueous electrolyte solution was prepared, comprising 0.1 M sulfuric acid (Fischer Scientific, Waltham, MA), 0.1 M ammonium perrhenate (Rhenium Alloys, Inc., North Ridgeville, OH), 4.7 M lithium chloride (Sigma Aldrich, St. Louis, MO), and 0.26 M citric acid (Sigma Aldrich). The pH was then adjusted to 1.0 using ammonium hydroxide (Sigma Aldrich).

The electrolyte solution was operated at a temperature of 35° C.

A pulse-reverse waveform was applied with a cathodic current density of 400 mA/in$^2$ for 30 ms and an anodic current density of 40 mA/in$^2$ for 60 seconds. The plating rate was 0.38 micron/hour. This waveform pattern was applied for 72 hours.

The results may be seen in FIGS. 1A and 1B. In FIG. 1A, a micron thickness rhenium electrodeposition on the substrate is shown. The coating is homogenous and conformal to the substrate. In FIG. 1B, an SEM image of the rhenium coating is depicted. Again, it can be seen that the coating is uniform and homogenous.

Example 2 Electroplating Copper

The substrate material, copper, was first cleaned and prepared for electroplating.

An aqueous electrolyte solution was prepared, comprising 0.1 M sulfuric acid (Fischer Scientific), 0.1 M ammonium perrhenate (Rhenium Alloys, Inc.), 4.7 M lithium chloride (Sigma Aldrich), and 0.52 M citric acid (Sigma Aldrich). The pH was then adjusted to 1.0 using ammonium hydroxide (Sigma Aldrich).

The electrolyte solution was operated at a temperature of 25° C.

A pulse-reverse waveform was applied with a cathodic current density of 400 mA/in$^2$ for 30 ms and an anodic current density of 40 mA/in$^2$ for 60 seconds. The plating rate was 0.2 micron/hour. This waveform pattern was applied for 12 hours.

The results may be seen in FIG. 2. As with the gold-coated stainless steel substrate, the rhenium forms a uniform, homogenous coating on the copper substrate. The differences in the methods of Examples 1 and 2, which both resulted in uniform coatings, demonstrate the robustness of the presently-described rhenium coating process.

What is claimed:

1. A method of electrodepositing a rhenium layer on a substrate, the method comprising:

i) providing an electrodeposition system, wherein the electrodeposition system comprises an anode, a cathode, an electrolyte solution, and a power supply; wherein the cathode comprises the substrate to be coated; wherein the power supply is connected to the anode and the cathode; wherein the anode and the cathode are in the electrolyte solution; and wherein the electrolyte solution comprises a rhenium compound, a first salt, and an acid;

ii) using the power supply to provide electrical power in a waveform to the cathode and the anode; wherein the waveform is a pulse waveform or a pulse reverse waveform; the pulse waveform comprising a cathodic pulse and a period without current; the pulse reverse waveform comprising a cathodic pulse and an anodic pulse, thereby electrodepositing a rhenium layer on the substrate; wherein a) the anodic pulse or the period without a current has a duration from 2-1000 seconds; or b) the ratio of the duration of the cathodic pulse to the duration of the anodic pulse or the period without a current is from about 1:100 to 1:200,000.

2. The method of claim 1, wherein the electrolyte solution further comprises a base.

3. The method of claim 1, wherein the electrolyte solution further comprises a second salt, the second salt comprising a metal; and wherein the metal is electrodeposited with the rhenium, thereby forming a rhenium-metal alloy layer on the substrate.

4. The method of claim 3, wherein the second salt comprises a metal selected from the group consisting of iron, nickel, and cobalt.

5. The method of claim 1, wherein the rhenium compound is selected from the group consisting of a rhenium salt and a rhenium acid.

6. The method of claim 5, wherein the rhenium salt is selected from the group consisting of ammonium perrhenate, potassium perrhenate, and sodium perrhenate.

7. The method of claim 1, wherein the first salt is a lithium salt and/or or a chloride salt.

8. The method of claim 1, wherein the electrolyte solution comprises at least one of sulfuric acid and citric acid.

9. The method of claim 1, wherein the electrolyte solution has a pH from about 0.7-2.0.

10. The method of claim 1, wherein the cathodic pulse has a duration from 1-500 ms.

11. The method of claim 1, wherein the anodic pulse or the period without a current has a duration from 2-1000 seconds.

12. The method of claim 1, wherein the ratio of the duration of the cathodic pulse to the duration of the anodic pulse or the period without a current is from about 1:100 to 1:200,000.

13. The method of claim 1, wherein the ratio of the current density of the cathodic pulse to the current density of the anodic pulse is from about 2:1 to about 50:1.

14. The method of claim 1, wherein the substrate is selected from the group consisting of a metal, a carbon-based material, and a plastic.

15. The method of claim 1, wherein the electrodeposition system is selected from the group consisting of a barrel plating system, a rack plating system, and a vibratory plating system.

* * * * *